US007273131B2

(12) United States Patent
Urmson, Jr. et al.

(10) Patent No.: US 7,273,131 B2
(45) Date of Patent: Sep. 25, 2007

(54) TOP OF RAIL APPLICATOR

(75) Inventors: W. Thomas Urmson, Jr., Valencia, PA (US); John W. Mospan, Pittsburgh, PA (US); Frank T. Lenco, Pittsburgh, PA (US)

(73) Assignee: Portec Rail Products, Inc., Pittsburgh, PA (US)

( * ) Notice: Subject to any disclaimer, the term of this patent is extended or adjusted under 35 U.S.C. 154(b) by 0 days.

(21) Appl. No.: 11/183,190

(22) Filed: Jul. 15, 2005

(65) Prior Publication Data

US 2005/0269161 A1 Dec. 8, 2005

Related U.S. Application Data

(63) Continuation of application No. 09/937,792, filed on Jan. 15, 2002, now Pat. No. 6,971,479.

(51) Int. Cl.
*B61K 3/00* (2006.01)

(52) U.S. Cl. ..... 184/3.1; 184/3.2; 104/279; 198/500

(58) Field of Classification Search ..... 184/3.1, 184/3.2, 15.1, 17, 21; 104/279; 198/500
See application file for complete search history.

(56) References Cited

U.S. PATENT DOCUMENTS

| | | | | |
|---|---|---|---|---|
| 1,889,313 | A | 11/1932 | Graham | |
| 2,152,696 | A | 4/1939 | Huck | |
| 2,489,182 | A | 11/1949 | Huck | |
| 2,887,179 | A | 5/1959 | Steele et al. | |
| 3,059,724 | A * | 10/1962 | Soule, Jr. | 184/3.1 |
| 3,147,822 | A | 9/1964 | Watts | |
| 4,088,078 | A | 5/1978 | Noble | |
| 4,811,818 | A | 3/1989 | Jamison | |
| 5,054,582 | A | 10/1991 | Aracil | |
| 5,076,396 | A | 12/1991 | Foote | |
| 5,394,958 | A | 3/1995 | Junk et al. | |
| 5,641,037 | A | 6/1997 | Wise et al. | |
| 2002/0056592 | A1* | 5/2002 | Arens et al. | 184/3.1 |
| 2003/0141148 | A1* | 7/2003 | DiCarlo | 184/3.1 |

FOREIGN PATENT DOCUMENTS

| | | |
|---|---|---|
| DE | 921 946 | 1/1955 |
| FR | 1.333.636 | 6/1963 |
| GB | 718398 | 11/1954 |
| JP | 31-5805 | 7/1956 |
| JP | 34-1303 | 2/1959 |
| JP | 34-18702 | 11/1959 |
| JP | 43-24722 | 10/1968 |
| JP | 52-52323 | 11/1977 |
| JP | 55-50050 | 11/1980 |
| JP | 3-14448 | 3/1991 |
| JP | 7-17402 | 1/1995 |
| JP | 2588797 | 11/1998 |
| WO | WO88/10204 | 12/1988 |

* cited by examiner

*Primary Examiner*—David M. Fenstermacher
(74) *Attorney, Agent, or Firm*—The Webb Law Firm

(57) ABSTRACT

An applicator (10) for applying a friction modifying material to the top of rails (12). The wayside applicator includes an applicator bar (26) that has a dam for holding friction modifying material.

4 Claims, 6 Drawing Sheets

TOP OF RAIL APPLICATOR

CROSS-REFERENCE TO RELATED APPLICATIONS

This application is a continuation of U.S. patent application Ser. No. 09/937,792, filed Jan. 15, 2002 now U.S. Pat. No. 6,971,479, which is the United States National Phase of PCT/US00/09269.

BACKGROUND OF THE INVENTION

1. Field of the Invention

The present invention relates to an apparatus for lubricating railroad rails or for applying friction modifiers to railroad rails.

2. Description of the Invention Background

In the operation of railroads, it has long been the practice to apply grease or friction modifier materials onto railroad rails, such as to the top of rails or sides of the rails at curves, turnouts, switches, in some cases the sections of the track immediately before a switch, and periodically spaced along the length of the track. Such lubricants and friction modifying materials, such as grease, can either reduce or increase the friction where necessary to improve train performance and reduce wear on both the rails and the train wheels.

In the case of a friction modifying material, i.e., a material that increases the friction between the train wheel and the rail, the practice has been to apply the friction modifier material to the top of the rail to contact the train wheels. However, such prior art devices have been less than adequate. Either the friction modifying material does not reach the center of the rail or substantial amounts of friction modifying material are wasted by dripping or pouring along the sides of the rail.

Therefore, it is an object of the present invention to overcome this limitation.

SUMMARY OF THE INVENTION

The present invention is a wayside application system for applying a friction modifying material to the top of railroad rails. More specifically, the present invention is a top of rail applicator bar for applying the material or lubricant to the head of a rail and includes a body; a flow passageway defined in the body for the material to flow through, the flow passageway defining an exit end; and a dam defined adjacent to the exit end and adapted to contain the material with the head of the rail. The applicator bar dam is preferably made of an elastomeric material, such as Neoprene. Preferably, the dam includes a D-shaped seal. The applicator bar can also include a flexible skirt for enclosing an upper portion of the dam. The skirt and a portion of the rail define a material exit to direct the material toward a crown portion of the rail.

The applicator bar forms a part of a top of a rail applicator system that includes a reservoir for supplying the material such as a friction modifying material or lubricant which is in fluid communication with the flow passageway and a pump. The pump is actuated by a pump actuator which is adapted to come in contact with the wheels of a rail vehicle. In lieu of a pump actuator, any type of pumping/activating arrangement can be provided such as a wheel detector coupled through a controller, to an electric motor, whereby once the wheel detector detects train wheels, the electric motor is activated and coupled to the pump to supply the friction modifying material or lubricant to the flow passageway. In operation the applicator bar applies the friction modifying material or lubricant by coaction of the rail wheel with the dammed material.

DETAILED DESCRIPTION OF THE PREFERRED EMBODIMENTS

Figure 1:
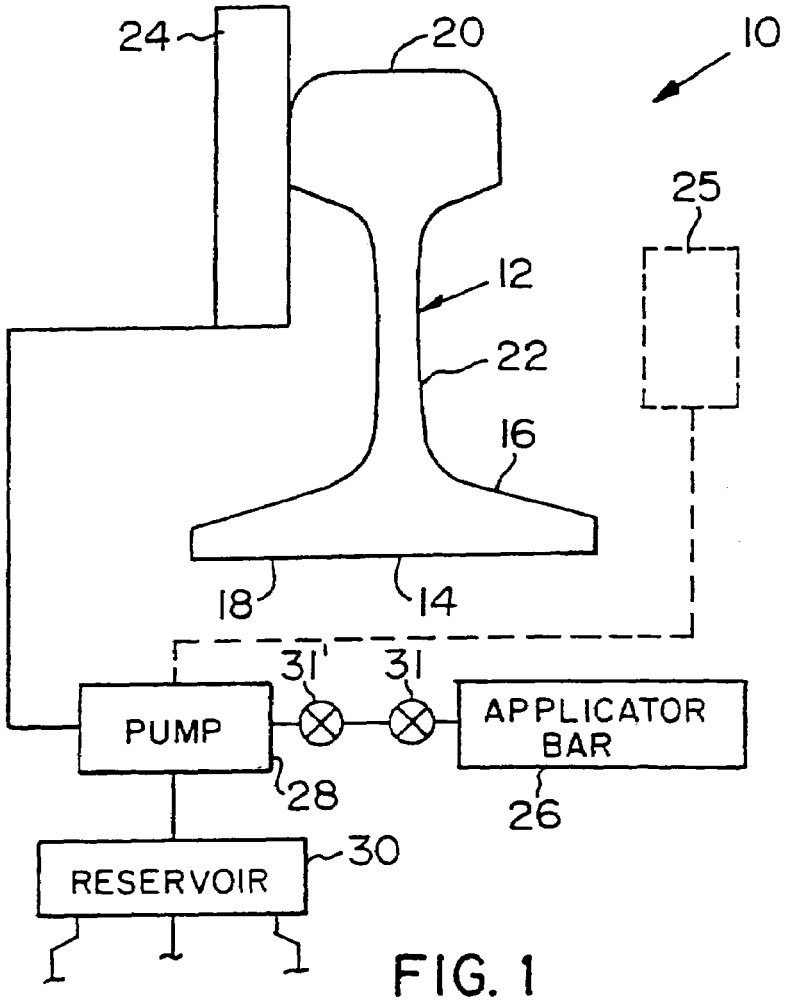
FIG. 1 is a partial schematic view of a railway rail friction modifying apparatus made in accordance with the present invention.

FIG. 1 shows a partial schematic of a top of rail applicator 10 made in accordance with the present invention. Specifically, FIG. 1 shows the railway top of rail applicator 10 for use with railroad rails 12. Each rail 12 includes a base 14 that has flanges 16 and 18 extending therefrom. The rail 12 also includes a head 20 and a web 22 which secures the head to the base 14. A pump actuator 24 is provided, which is substantially the same as the pump actuator disclosed in U.S. Pat. No. 5,394,958, which is hereby incorporated herein by reference. Alternatively, a wheel detector through a controller is coupled with an electric motor arrangement 25, shown in phantom, can be used in lieu of the pump actuator 24. The pump actuator 24 is secured to the rail 12 via clamps, such as S-shaped clamps. The pump actuator 24 or the arrangement 25 coacts with an applicator bar 26 which is schematically shown in FIG. 1. The pump actuator 24 includes a pump 28 that is in fluid communication with a reservoir 30. In operation a rail wheel, such as a locomotive wheel, contacts the pump actuator 24, thereby, activating the pump 28 and supplying the friction modifying material or a lubricant to the applicator bar 26. The applicator bar 26 is arranged to provide friction modifying material adjacent the field surface or outside surface of the rail head 20 as opposed to the gauge surface or inside surface of the rail head 20. Alternatively, the arrangement 25 is activated by the presence of a rail wheel passing thereby. Typically, the pump actuator 24 and/or the arrangement 25 are placed in close proximity to the applicator bar 26, while the reservoir is positioned twenty-five to thirty feet from the applicator bar 26.

Typically, the electric motor of the arrangement 25 is operated by 220 volt AC, 110 volt AC or 12 volt DC, for example. The electric motor can be so arranged so that the friction modifying material or lubricant is supplied to every wheel, or every other wheel, etc. Generally, four applicator bars 26 are supplied by one reservoir 30. It has been found that if the friction modifying material has a viscosity similar to water, then check valves 31 are provided in fluid communication with each applicator bar 26 to prevent the reverse flow of the friction modifying material. Also, flow control valves, such as globe valves 31', can be provided to control flow through each of the applicator bars 26.

Figure 2:
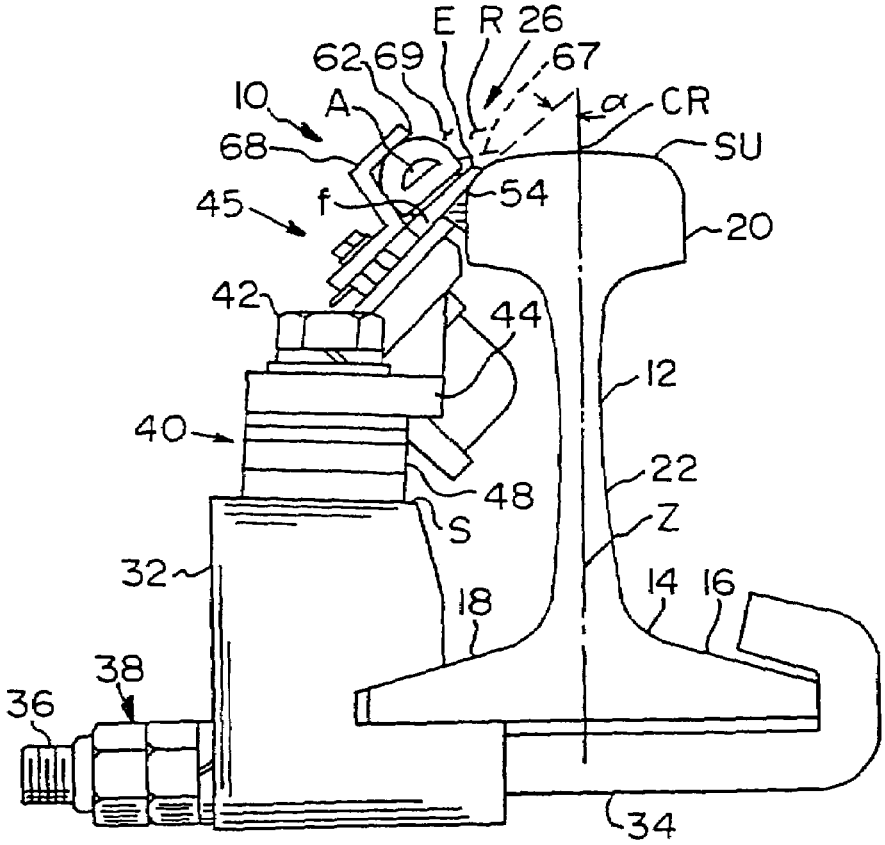
FIG. 2 is an end elevational view partially in section of an applicator bar coacting with a rail made in accordance with the present invention.
Figure 3:
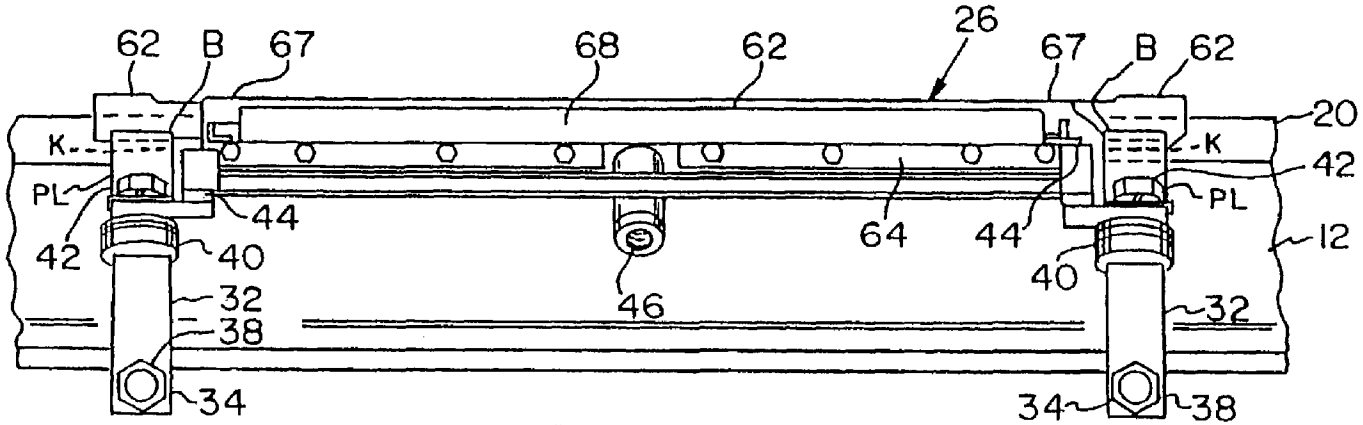
FIG. 3 is an elevational plan view of the applicator bar shown in FIG. 2.

A first embodiment of the applicator bar 26, made in accordance with the present invention, is shown in FIGS. 2-6. Referring specifically to FIGS. 2 and 3, the applicator bar 26 is mounted to the rail 12 through two oppositely positioned mounting clamps 32. Each mounting clamp 32 includes a J-bolt 34 having a J-shaped end adapted to receive the flange 16. Each J-bolt 34 includes a threaded end 36 that passes through the mounting clamp 32. The mounting clamp 32 also includes a recess adapted to receive the flange 18. Nuts and a lockwasher 38 are received at the threaded end 36 to securably hold the mounting clamp 32 to the rail 12. Spacers 40 are provided on an upper surface of the mounting clamp 32 onto which an applicator bar mounting body 44 is secured through a fastener 42. The fastener 42 has a threaded end that is threadably secured to the mounting clamp 32. The applicator bar 26 is secured to the applicator bar mounting body 44.

Figure 4:
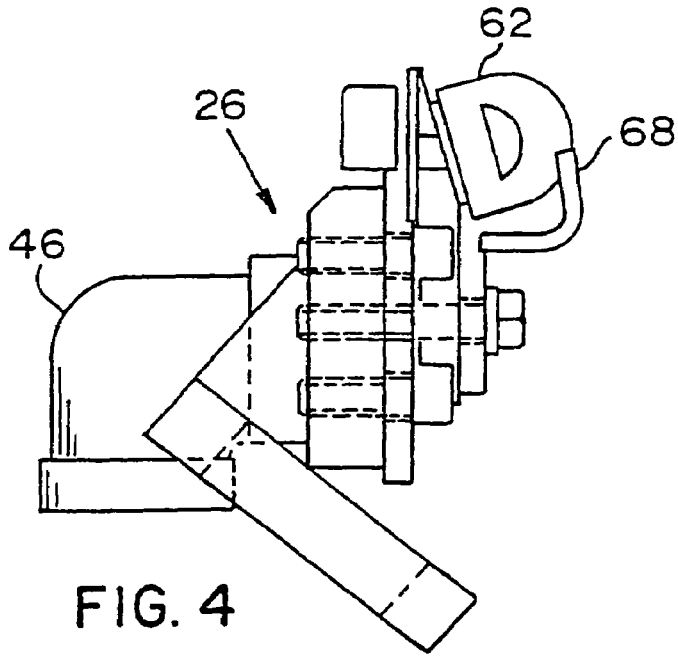
FIG. 4 is an elevational end view of a portion of the applicator bar shown in FIG. 2.
Figure 6:
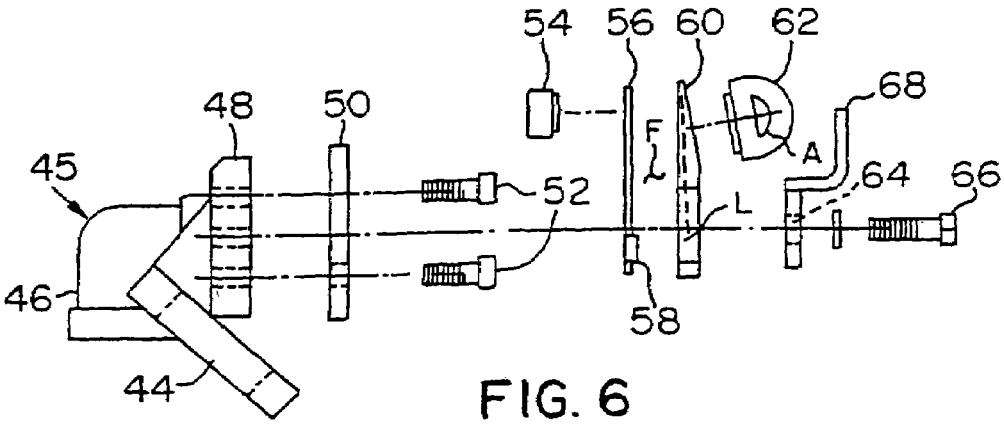
FIG. 6 is an exploded elevational view of the portion of the applicator bar shown in FIG. 2.
Figure 5:
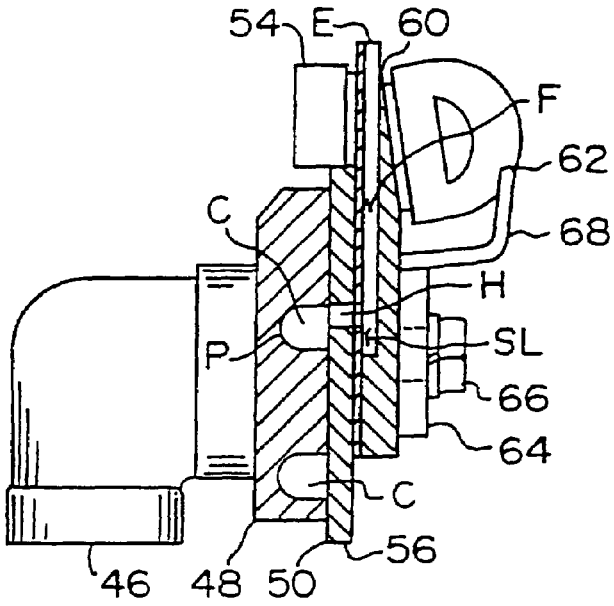
FIG. 5 is a partial sectional elevational view of the applicator bar shown in FIG. 4.

Referring to FIGS. 4-6, the applicator bar 26 includes a body 45 that includes an inlet 46 which is in fluid communication with the pump 28 through hosing (not shown) connecting the inlet 46 to the pump 28. The inlet 46 is secured and is in fluid communication with a manifold 48. The manifold 48 includes a plurality of channels C, similar to the channels disclosed in U.S. Pat. No. 5,394,958. A manifold bar 50 is secured to the manifold 48 by fasteners 52. A fluid passageway P is defined by channels C formed in the manifold 48 and holes H provided in the manifold bar 50, similar to that as disclosed in U.S. Pat. No. 5,394,958. Preferably, all of the surfaces defining the fluid passageways are lined with Teflon®. An inner seal 54 is provided and secured to a front blade 56. The front blade 56 abuts against an outer surface of the manifold bar 50. The front blade 56 includes a plurality, in this case two, of slots SL aligned with holes H. The front blade 56 includes a plurality of aligning tabs 58. A distribution blade 60 receives the aligning tabs 58 and abuts against the front blade 56. The distribution blade 60 includes slots L that receive tabs 58 and abut against the front blade 56. A vertical flow passageway F is defined by inner surfaces of the front blade 56 and the distribution blade 60.

An elongated "D-shaped seal" 62 is secured to an outer surface of the distribution blade 60. A back bar 64 is secured to the distribution blade 60. Fasteners 66 pass through the back bar 64, the distribution blade 60, the front blade 56, the manifold bar 50 and the manifold 48 securing the members to one another. The back bar includes an angle bracket 68 to hold a back surface of a seal 62 in place. The manifold channels C, the holes H and slots SL and the space defined front blade 56 and the distribution blade 60 define the flow passageway F, all of which are in fluid communication with each other and permit a friction modifying material to flow therethrough.

Figure 7:
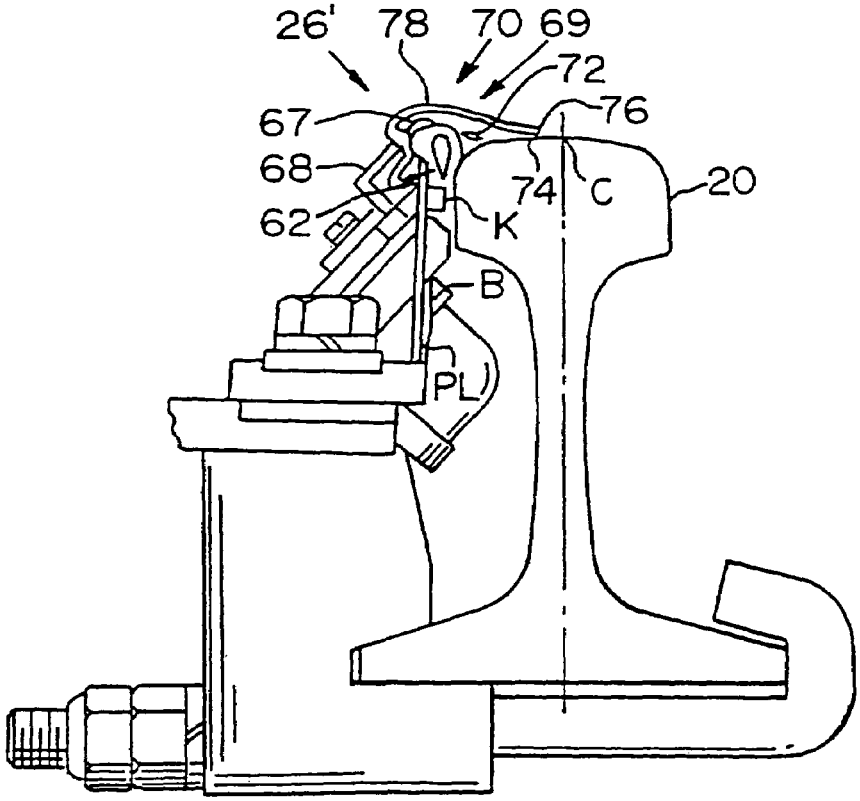
FIG. 7 is an end elevational view of another embodiment of the applicator bar made in accordance with the present invention.

Referring back to FIG. 2, the applicator bar 26 is secured to the rail 12 through the J-bolts 34. The spacers 48, which can be varying numbers, are provided so that the inner seal 54 abuts and seals against the head 20 of the rail 12. The inner seal 54 extends along substantially for the entire length of the applicator bar 26. The exit E of the flow passageway F is defined by upper ends of the distribution blades 60 and the front blade 56. In this arrangement, the D-shaped seal has an upper surface positioned above the crown CR of the rail head. Further, as shown in FIG. 3, ends 67 of the D-shaped seal are pressed against the rail head 20 by end brackets B. The crown CR of the rail head is contained on an upper surface SU of the rail. Each end bracket B includes an elongated plate PL attached to one of the applicator bar mounting bodies 44, a piece of key stock K, which is attached to plate PL, is arranged to sandwich the D-shaped seal 62 against the rail head 20 as shown in FIG. 7. This arrangement will create a reservoir R or dam 69, through a dammed structure defined by the ends 67 and the D-shaped seal 62, the inner seal 54 and an upper end surface of the rail head 20. The dam is positioned adjacent exit end E. The inner seal 54 prevents the friction modifying material from flowing between the rail head 20 and the applicator bar 26, although with a thick friction modifying material, such as grease, the dam 69 may not require the inner seal 54. However, with less viscous materials, such as water based materials, the inner seal should be used. Preferably, D-shaped seal 62 and the inner seal 54 are made of an elastomeric, flexible material, such as Neoprene/EPDM/SBR closed cell sponge rubber. Seals 54 and 62 are provided with adhesive backings so that they can be adhesively secured to the respective parts of the applicator bar 26. The D-shaped seal 62 has an inner air pocket A between the Neoprene curved member and straight member. It has been found that this arrangement can survive the compression caused by rail wheels contacting the D-shaped seal 54 and compressing the D-shaped seal 62 over a long period of time. Although it is preferable to use the above described seals, any other type of elastic seal will suffice. Also, to prevent the D-shaped seal from being pulled away from the applicator bar 26, an angle bracket 68 (as shown in FIG. 7 and in FIGS. 2 and 4-6) can be provided and which is discussed below.

In operation a railroad vehicle travels along the rail 12. Initially a rail wheel of the railroad vehicle passes over the pump actuator 24 thereby activating the pump 28. The pump 28 provides friction modifying material from the reservoir 30 to the applicator bar 26. Alternatively, the previously described arrangement 25 can be provided in lieu of the pump actuator 24. Specifically, the friction modifying material passes through the inlet 46 into the manifold 48 and is distributed along the length of the applicator bar 26. The friction modifying material then passes between the front blade 56 and distribution blade 60 through the flow passageway F and exits through the exit E directed to the rail head 20. The rail head 20, D-shaped seal 62, and inner seal 54 define the reservoir R of friction modifying material that terminate at the crown CR of the rail head 20. As the rail wheels then pass over the portion of the rail head 20 that is adjacent to the applicator bar 26, the friction modifying material, which is directed to the upper surface SU through exit E, then contacts the rail wheel, typically near the crown CR of the rail head 20. When using the arrangement 25, the friction modifying material can be supplied to a varying number of wheels or all of the wheels.

FIG. 7 shows an alternative embodiment of an applicator bar 26' of the present invention with like numerals used for like elements. Essentially, applicator bar 26' is the same as the applicator bar 26 except for the following differences. Specifically, a Neoprene skirt 70 is secured to an upper portion of the applicator bar 26' through the angle bracket 68. The angle bracket 68 is secured to the back bar 64 via welding. An end of the angle bracket 68 is positioned adjacent the D-shaped seal 62 so that the skirt 70 is sandwiched between the D-shaped seal and the bracket 68. The angle bracket 68 is also used without the skirt 70 to hold the D-shaped seal 62 in place. The skirt 70 extends toward the crown CR of the rail head 20. It is important to note that the skirt 70 should be flexible. The skirt 70 extends substantially along the length of the applicator bar 26'. In this arrangement, a reservoir area 72 is defined, that is bounded by a portion of the rail head 20, an inner surface of the skirt 70, the D-shaped seal 62 and the inner seal 54. Operation of the applicator bar 26' is similar to that as previously described for applicator bar 26, except, that as the rail wheels pass over the skirt 70 lubricant is squeezed onto the rail head through a passageway 74 defined by the end of the skirt 70 and the rail head 20. The skirt 70 is arranged to provide the friction modifying material toward an upper surface. It has been found that this arrangement improves the application of the friction modifying material to the rail 12 and rail wheels. Further, it has been found that the skirt 70 prevents excess friction modifying material flowing from around the seals and it has been found that the skirt 70, which is positioned adjacent the exit end E, prevents evaporation of the friction modifying material over time and prevents clogging of the exit passageway defined between the front blade and distribution blade 60 through the evaporation of the friction modifying material. Furthermore, it has been found that the skirt 70 prevents excess dirt and other materials from clogging the exit passageway E. The skirt 70 can be replaced periodically due to wear. It has also been found that the skirt end 76 should be positioned below the crown CR of the rail head 20 for the best results. It has also been found that the tread or outer edge of the rail wheel should contact an intermediate portion 78 of the skirt 70 for the best application of the friction modifying material. Preferably, the skirt is made of a flexible elastomeric material, although it may be made of other materials such as metal.

Figure 9:
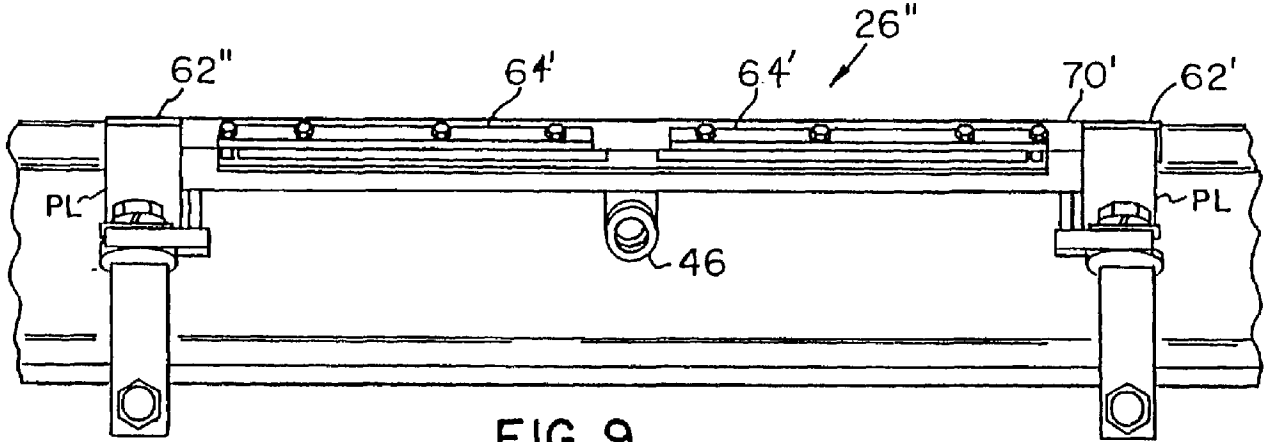
FIG. 9 is an elevational view of the embodiment shown in FIG. 8 attached to a rail.
Figure 8:
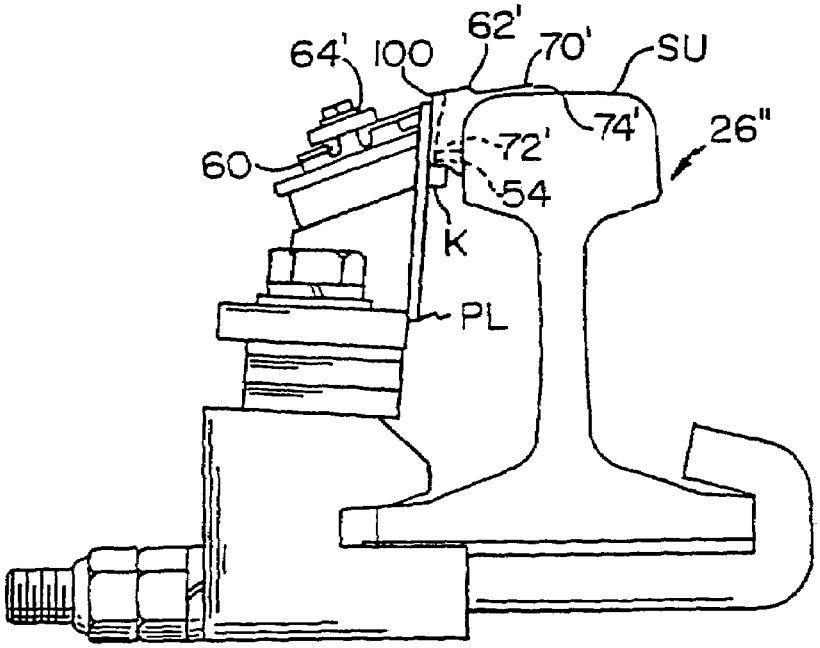
FIG. 8 is an elevational end view of another embodiment of the applicator bar made in accordance with the present invention.

FIGS. 8 and 9 show another alternative embodiment 26" of an applicator bar similar to that shown in FIGS. 1-6, except for the below noted difference. Like reference numerals will be used for like elements.

First, the single elongated D-shaped seal 62 is eliminated and two substitute D-shaped seals 62' and 62" are provided only on the ends of the applicator bar, wherein a flat surface 100 of the D-shaped seals 62' and 62" have an adhesive that permits the respective D-shaped seals 62' and 62" to be attached to plates PL. A portion of the D-shaped seals 62' and 62" extend into the back bar 64'. Back bar 64' is similar to back bar 64 except the L-shaped extension (bracket 68) is not provided. The D-shaped seals 62' and 62" extend into the bracket and contact ends of inner seal 54.

Preferably, a skirt 70' is secured to an outer surface of the guide blade 60 and held in place by the back bar 64'. The skirt 70' may be a rectangular metallic sheet, a polymeric material that may contain reinforcing fibers, such as a Kevlar® sheet with fiberglass fibers, or polymeric rubber material such as Neoprene.

Operation of the applicator bar 26" is similar to that as applicator bar 26' except that as the rail wheels pass over the skirt 70', lubricant is squeezed onto the rail head between a passageway 74' defined by an end of the skirt 70' and the rail head 20. Alternatively, the skirt 70' need not be flexible and the material flows through 74' due to pump activation. Also, in this arrangement the reservoir area 72' is defined by the area that is bounded by a portion of the rail head 20, an inner surface of the skirt 70', the D-shaped seals 62' and 62", the front blade 56 and the inner seal 54. As can be seen with respect to the embodiments 26', 26" and 26''', the skirts 70, 70' and the end 200 of the distribution blade 60 are positioned adjacent the exit end E and direct the material to the upper surface SU of the rail. Preferably, the skirts 70, 70' and the end 200 of the distribution blade 60 are positioned over portions of the rail upper surface SU.

Figure 10:
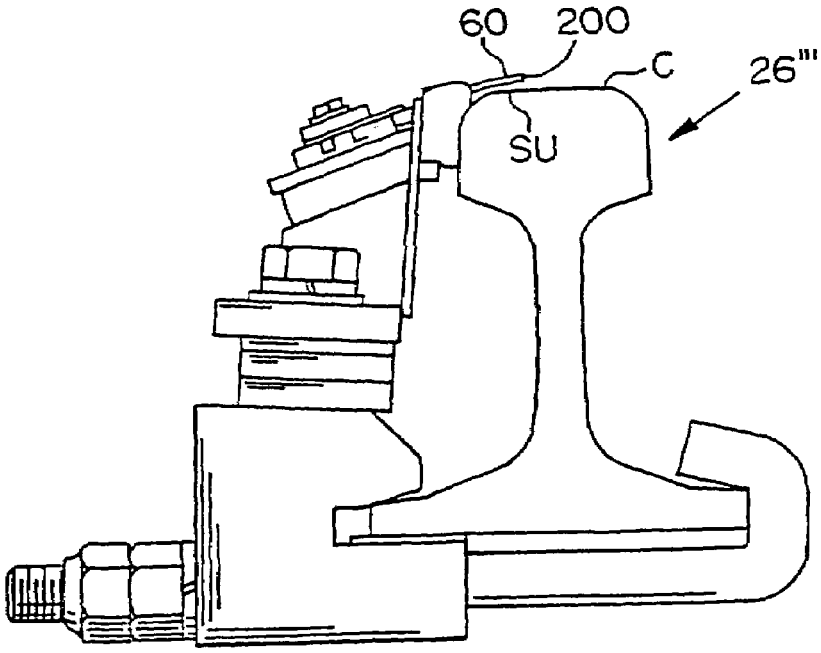
FIG. 10 is an end view of another embodiment of an applicator bar made in accordance with the present invention.

FIG. 10 shows yet another embodiment of an applicator bar 26''', which is similar to applicator bar 26", except for the below noted difference. Like reference numerals are used for like elements. The skirt 70' is not present in the applicator bar 26''', however, the distribution blade 60 is of substantial length so as to have an end portion with an end 200 in close proximity to the crown CR wherein the end portion, acts as a skirt, thereby eliminating the need for the separate skirts 70 and 70".

Figure 12:
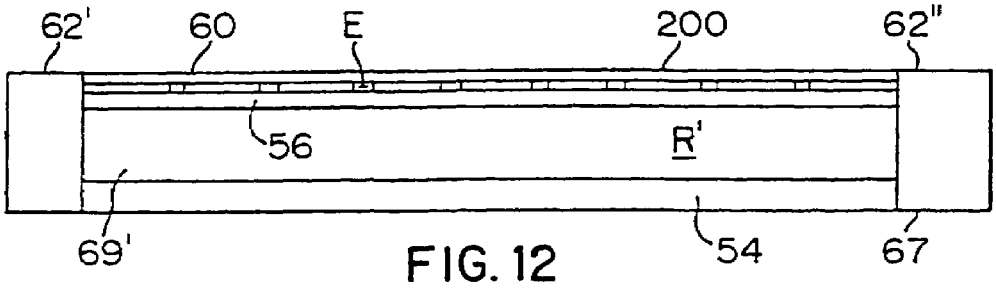
FIG. 12 is a front elevational view of a portion of the applicator bar shown in FIG. 10.
Figure 11:
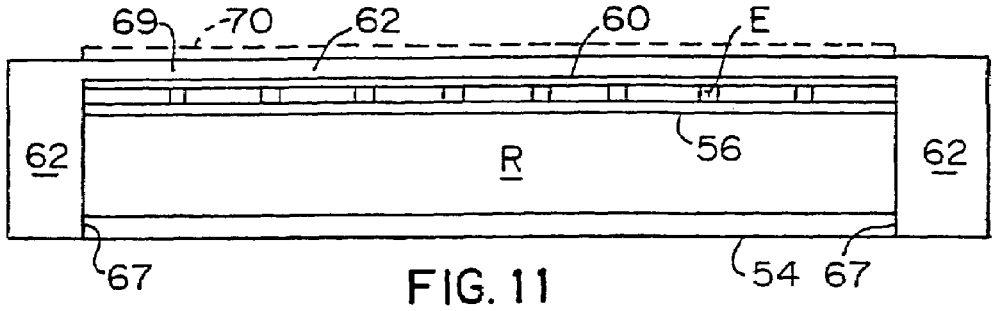
FIG. 11 is a front elevational view of a portion of the applicator bar shown in FIG. 2.

FIG. 11 shows the reservoir R or dam 69 of the applicator bar 26. FIG. 12 shows the reservoir R' or dam 69' of the applicator bar 26". Skirt 70 is shown in phantom on FIG. 11.

Figure 13:
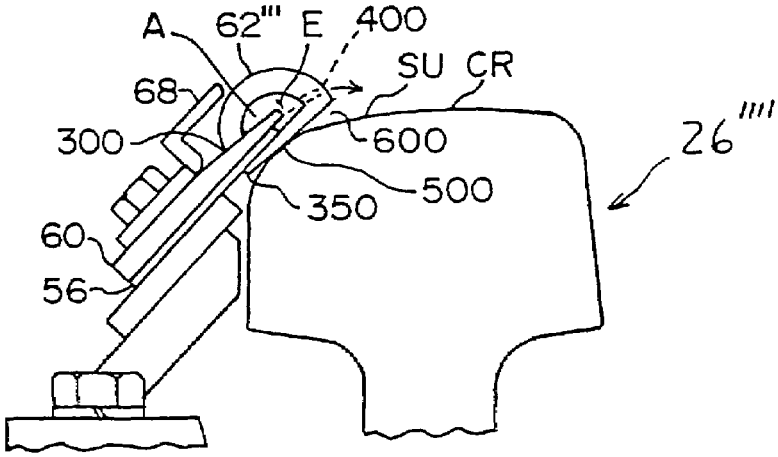
FIG. 13 is an end elevational view of another embodiment of an applicator bar made in accordance with the present invention.
Figure 14:
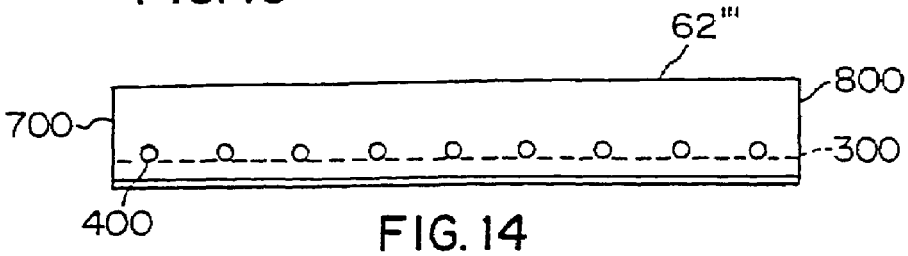
FIG. 14 is an elevational view of a D-shaped seal shown in FIG. 13.

FIGS. 13 and 14 show another embodiment of an applicator bar 26'''', which is similar to applicator bar 26 except for the below noted differences. Like reference numerals are used for like elements. A D-shaped seal 62''' is provided similar to D-shaped seal 62, except a slot 300 is cut along a lower edge of the D-shaped seal 62 defining a passageway 350 so that ends of the front blade 56 and the distribution blade 60 are received within the D-shaped seal 62''' and the exit E is in fluid communication with the air pocket A. D-shaped seal 62''' acts like a skirt. A plurality of holes 400 are defined on the D-shaped seal which are in fluid communication with the air pocket A. The holes are arranged to direct friction modifying material toward the rail upper surface SU and the rail crown CR. The inner seal 54 is replaced by a portion 500 of the D-shaped seal 62'''. The D-shaped seal 62''' is flexible and acts as a distributer having a D-shaped body. The plurality of holes 400 are in fluid communication with the exit end E and the air pocket A or reservoir chamber. Ends 700 and 800 of the D-shaped seal 62''' are clamped as previously described. Further, a silica gel material can be provided at the ends 700 and 800 to seal off the ends to prevent leakage of the friction modifying material. In operation friction modifying material flows from exit E into air pocket A and out of holes 400 toward the upper surface SU and the crown CR. A reservoir 600 may be defined between portion 500 and the rail upper surface SU.

With reference to all of the applicator bars 26, 26', 26''' 26''' and 26'''', the position or the angle $\alpha$ (shown in FIG. 2) of entry through the exit of the passage E and the vertical axis Z passing through the rail web 22 can vary between, for example, 45°-70°. In other instances it is believed that the applicator bar exit E can be positioned away from the rail in any orientation, such as for example vertical, and an applicator attachment attached thereto which has a flow passageway to direct the friction modifying material to the rail upper surface SU and the crown CR. The vertical and horizontal position of the crown CR relative to the applicator bars 26, 26', 26", 26''' and 26'''', with the exception of the skirts 70 and 70', the seals and the distribution blade 60, may be varied to accommodate either passenger trains or freight trains, so that the train wheels do not come in contact with and damage the remaining structure of the applicator bars. Further, in some instances, the dam 69 or 69' may be removed and the friction modifying material is directed to the upper surface SU and the crown CR via the skirts 70 or 70', or distribution blade end 200, for example.

Having described the presently preferred embodiments of the invention, it is to be understood that it may be otherwise embodied within the scope of the appended claims.

It is claimed:

1. A wayside top of a rail applicator system, comprising: a rail that includes a head having an upper surface with a crown; and an applicator for applying a material on the upper surface of the head of the rail, said applicator comprising a body, a flow passageway defined in said body for the material to flow therethrough, the flow passageway including an elastomeric member contacting at least a part of said rail and forming a portion of an exit end for directing the material toward said crown of said rail.

2. A wayside top of rail applicator system as claimed in claim 1, wherein said applicator includes a skirt positioned adjacent the exit and formed from one of a flexible material or an elastomeric material.

3. A wayside top of rail applicator system as claimed in claim 1, wherein said applicator includes a distribution blade formed from a metal.

4. A wayside top of rail applicator system as claimed in claim 2, wherein said skirt comprises a polymeric material containing reinforcing fibers.

* * * * *

UNITED STATES PATENT AND TRADEMARK OFFICE

CERTIFICATE OF CORRECTION

PATENT NO. : 7,273,131 B2
APPLICATION NO. : 11/183190
DATED : September 25, 2007
INVENTOR(S) : W. Thomas Urmson, Jr. et al.

It is certified that error appears in the above-identified patent and that said Letters Patent is hereby corrected as shown below:

Title Page; Face of the Patent, See Item (63) Related U.S. Application Data, line 2, after "now Pat. No. 6,971,479", insert the following: -- which is the United States National Phase of PCT/US00/09269, filed April 7, 2000. --

Signed and Sealed this

Twenty-ninth Day of April, 2008

JON W. DUDAS
*Director of the United States Patent and Trademark Office*